US006048261A

United States Patent [19]

Broido

[11] Patent Number: 6,048,261

[45] Date of Patent: Apr. 11, 2000

[54] POLISHING DISC SUPPORT AND POLISHING PROCESS

[75] Inventor: Georges Henri Broido, St Julien En Genevois, France

[73] Assignee: Lam-Plan S.A., Gaillard, France

[21] Appl. No.: 08/885,421

[22] Filed: Jun. 30, 1997

[30] Foreign Application Priority Data

Jun. 28, 1996 [FR] France ..... 96 08076

[51] Int. Cl.[7] ..... B24D 9/08

[52] U.S. Cl. ..... 451/548; 451/490

[58] Field of Search ..... 451/28, 490, 533, 451/538, 921, 548, 550, 508, 41, 905

[56] References Cited

U.S. PATENT DOCUMENTS

| | | | |
|---|---|---|---|
| 2,747,343 | 5/1956 | Gekkert | 451/342 |
| 5,564,965 | 10/1996 | Tanaka et al. . | |
| 5,876,269 | 3/1999 | Torii | 451/41 |
| 5,893,755 | 4/1999 | Nakayoshi | 451/41 |

FOREIGN PATENT DOCUMENTS

| | | | |
|---|---|---|---|
| 0658401 | 6/1995 | European Pat. Off. . | |
| 0713897 | 5/1996 | European Pat. Off. . | |
| 2013896 | 10/1971 | Germany . | |
| 1193166 | 8/1989 | Japan | 451/288 |

OTHER PUBLICATIONS

International Search Report dated Mar. 14, 1997.

*Primary Examiner*—Robert A. Rose

*Attorney, Agent, or Firm*—Knobbe, Martens, Olson & Bear, LLP

[57] ABSTRACT

A polishing disc support comprising a body (1) in the form of a disc, the disc having two sides one of which has a center, a centering hole (4) being provided in said center and a drive hole (5) being provided in an eccentric position in this same side, wherein a coating (6) of a material which is softer than that of the body (1) is applied to the other side (3).

9 Claims, 1 Drawing Sheet

POLISHING DISC SUPPORT AND POLISHING PROCESS

Figure 1:
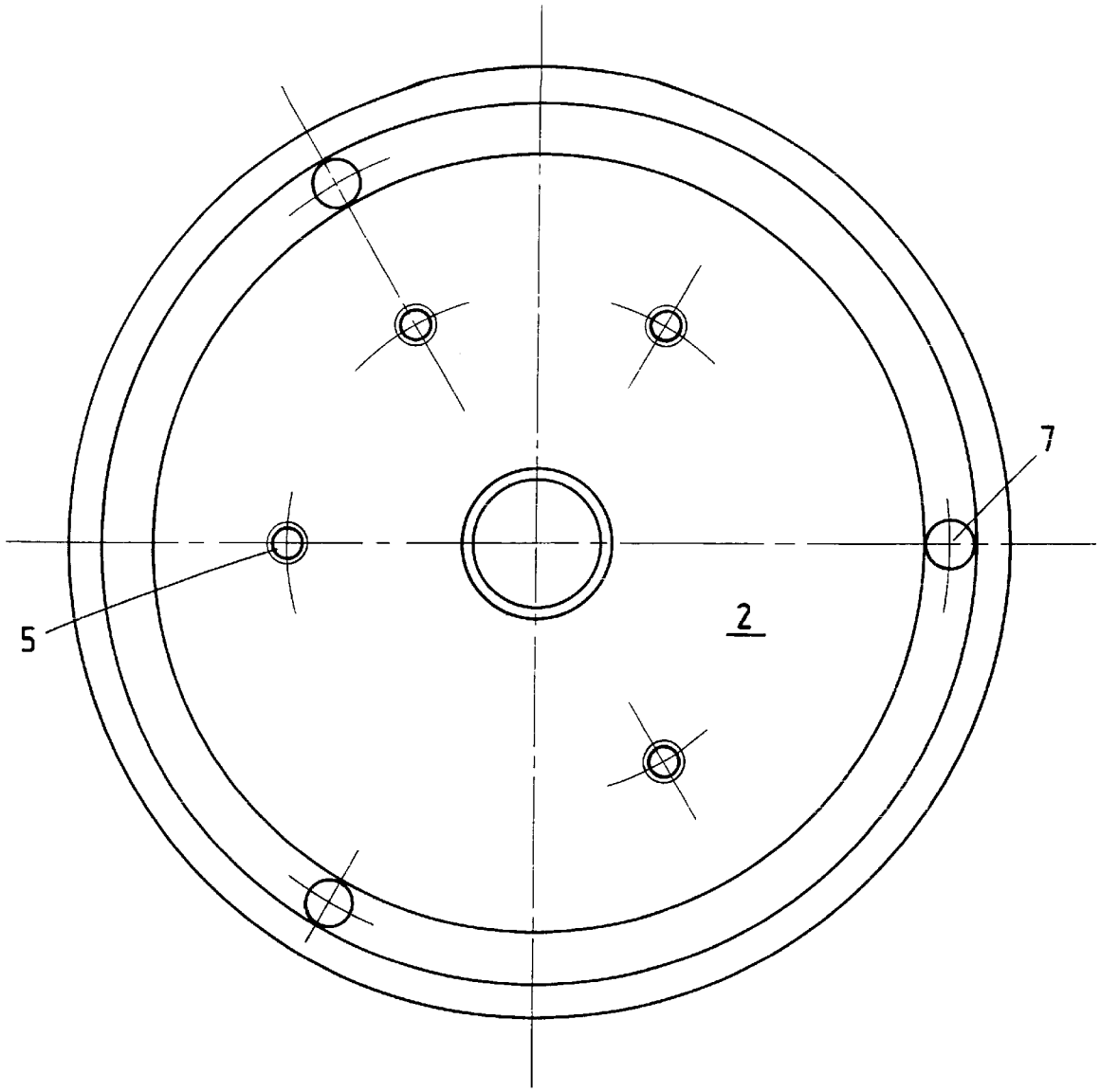

During the preparation of metallographic samples, it is sometimes necessary to change the polishing disc, generally of abrasive paper, during the process as a result of its becoming detached, torn or excessively worn. Replacing the used paper with fresh paper constitutes a major obstacle to the proper preparation of, in particular, fragile samples when, for example, deposited layers of the order of a few microns thick are to be revealed, as is frequently the case with multilayer printed circuits or in electronic components.

In fact, during the first few seconds of use of a new abrasive paper placed on a hard metal support (the polishing plate of the polishing machine) the abrasion is very aggressive and profoundly disturbs the material, with the result that the fine layers which are supposed to be observed are torn away. This unwanted removal of material is lessened and made much less noticeable if a support made of plastics (generally polyvinyl chloride) is used, which is not as hard as metal. However, these plastics supports lead to geometric deformation of the profile of the sample to be analysed by a loss of flatness caused by excessive rounding of the edges of the sample.

The invention relates to a polishing disc support which overcomes the drawbacks mentioned above by making it possible to change the polishing disc without the abrasion becoming too powerful during the first few seconds of use, whilst still achieving satisfactory flatness.

The polishing disc support according to the invention is formed by a body in the form of a disc. A centering hole for the support is provided in the centre of one side of the body. A drive hole adapted to cooperate with a drive pawl of a rotational drive means with a drive pawl of a rotational drive means is provided in an eccentric position in this same side. A coating of a material which is softer than that of the body is applied to the other side in a thickness of between 5 $\mu$m and 4 mm. By depositing a softer coating, notably plastics, on a hard body, particularly metal, the gentleness of the abrasion of the plastics body is combined with the absolute flatness obtained with a metal support. It has been found that a coating three microns thick does not reduce the abrasion sufficiently, whilst if the coating is more than two millimetres thick, deformation occurs similar to that obtained with an entirely plastic support.

It is preferable for the coating to have a Shore hardness D greater than 12 so as not to end up with a sample having a dented profile.

According to one very useful embodiment, the coating is of polytetrafluoroethylene. This makes it possible to detach and reattach an abrasive paper or polishing cloth which has been used before, for example for polishing a different material, and to reposition an abrasive paper or a polishing cloth which has been wrongly applied to the support and automatically eliminate the majority of the air bubbles trapped accidentally during the fitting of the abrasive paper or the polishing cloth. Owing to the very low adhesive power of polytetrafluoroethylene, the air bubbles are expelled by the pressure applied to the component which is to be polished.

The coating may be applied with a spray gun, e.g. by applying three successive layers 25 microns thick, but it is also possible to apply the coating in sheets, optionally layered, these sheets being chemically treated on one side to allow them to be stuck to a support with araldite or a double-sided adhesive. The coating may also take the form of a grid or a gauze, all of which, like the body, are disc-shaped. The body may also be layered, with a plate of aluminium or other hard material 1 to 5 mm thick being stuck to a cast iron or aluminium substrate.

Figure 2:
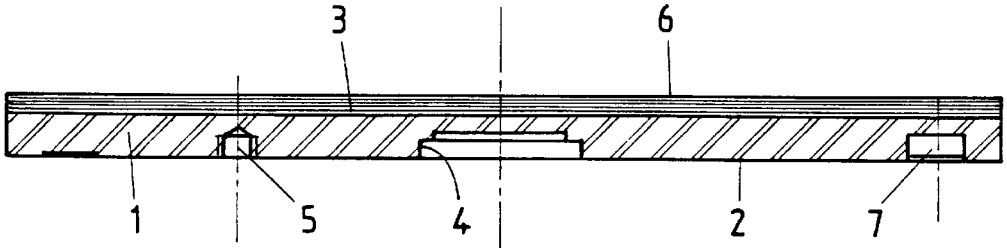

In the drawings, which are provided solely by way of example,

FIG. 1 is a view from below of a polishing disc support according to the invention and FIG. 2 is a sectional view thereof.

The support comprises an aluminium body 1 in the form of a disc with two sides 2 and 3. In the centre of the side 2 is a blind centering hole 4, whilst on this same side 2 are provided seven blind drive holes 5 and 7 adapted to cooperate with a drive pawl of a rotary drive motor. The arrangement of the holes 5 and 7 is such that there is always one which can cooperate with the pawl of a drive motor, whatever polishing machine is used.

On the side 3 of the body 1 there is a 100 microns thick polytetrafluoroethylene coating 6.

The following tests illustrate the invention.

TEST NO. 1 COMPARATIVE

Polishing Machine Fitted with an Uncoated Solid Aluminium Plate

Material of plate carrying the abrasive paper: aluminium
Mean hardness of the coating: None
Particle size of abrasive paper: P240
Polishing time: 3 min 45
Pressure on samples: 449 g/cm$^2$
Speed of rotation of plate: 250 rpm
Samples treated: 3
Material polished: steel
Polished under water: yes
Removal of metal: 0.48 g

TEST NO. 2 COMPARATIVE

Polishing Machine Fitted with an Aluminium Plate Having A 3$\mu$ PFTE Coating

Material of plate carrying the abrasive paper: aluminium
Thickness of coating on support plate: 3$\mu$
Mean hardness of the coating: 80 SHR D
Particle size of abrasive paper: P240
Polishing time: 3 min 45
Pressure on samples: 449 g/cm$^2$
Speed of rotation of plate: 250 rpm
Samples treated: 3
Material polished: steel
Polished under water: yes
Removal of metal: 0.48 g

TEST NO. 3

Polishing Machine Fitted with an Aluminium Plate Having a 10$\mu$ PFTE Coating

Material of plate carrying the abrasive paper: aluminium
Thickness of coating on support plate: 10$\mu$
Mean hardness of the coating: 80 SHR D
Particle size of abrasive paper: P240
Polishing time: 3 min 45
Pressure on samples: 449 g/cm$^2$
Speed of rotation of plate: 250 rpm Samples treated: 3
Material polished: steel
Polished under water: yes
Removal of metal: 0.27 g
The profile of the sample is good.

TEST NO. 4

Polishing Machine Fitted with an Aluminium Plate Having a 50μ PFTE Coating

Material of plate carrying the abrasive paper: aluminium
Thickness of coating on support plate: 50μ
Mean hardness of the coating: 80 SHR D
Particle size of abrasive paper: P240
Polishing time: 3 min 45
Pressure on samples: 449 g/cm$^2$
Speed of rotation of plate: 250 rpm
Samples treated: 3
Material polished: steel
Polished under water: yes
Removal of metal: 0.22 g
The profile of the sample is good.

TEST NO. 5

Polishing Machine Fitted with an Aluminium Plate Having a 100μ PFTE Coating

Material of plate carrying the abrasive paper: aluminium
Thickness of coating on support plate: 100μ
Mean hardness of the coating: 80 SHR D
Particle size of abrasive paper: P240
Polishing time: 3 min 45
Pressure on samples: 449 g/cm$^2$
Speed of rotation of plate: 250 rpm
Samples treated: 3
Material polished: steel
Polished under water: yes
Removal of metal: 0.22 g
The profile of the sample is good.

TEST NO. 6

Polishing Machine Fitted with an Aluminium Plate Having a 500μ PFTE Coating

Material of plate carrying the abrasive paper: aluminium
Thickness of coating on support plate: 500μ
Mean hardness of the coating: 80 SHR D
Particle size of abrasive paper: P240
Polishing time: 3 min 45
Pressure on samples: 449 g/cm$^2$
Speed of rotation of plate: 250 rpm
Samples treated: 3
Material polished: steel
Polished under water: yes
Removal of metal: 0.23 g
The profile of the sample is excellent.

TEST NO. 7

Polishing Machine Fitted with a Aluminium Plate Having a 2000μ (2 mm) PFTE Coating Material of plate carrying the abrasive paper: aluminium
Thickness of coating on support plate: 2000μ
Mean hardness of the coating: 80 SHR D
Particle size of abrasive paper: P240
Polishing time: 3 min 45
Pressure on samples: 449 g/cm$^2$
Speed of rotation of plate: 250 rpm
Samples treated: 3
Material polished: steel
Polished under water: yes
Removal of metal: 0.23 g The profile of the sample is excellent.

TEST NO. 8

Polishing Machine Fitted with an Aluminium Plate Having a 4000μ (4 mm) PFTE Coating Material of plate carrying the abrasive paper: aluminium
Thickness of coating on support plate: 4000μ
Mean hardness of the coating: 80 SHR D
Particle size of abrasive paper: P240
Polishing time: 3 min 45
Pressure on samples: 449 g/cm$^2$
Speed of rotation of plate: 250 rpm
Samples treated: 3
Material polished: steel
Polished under water: yes
Removal of metal: 0.28 g The profile of the sample is still satisfactory.

TEST NO. 9 COMPARATIVE

Polishing Machine Fitted with a Solid PVC Plate (12 mm thick)

Material of plate carrying the abrasive paper: PVC
Thickness of coating on support plate: 12 mm
Mean hardness of the coating: 80 SHR D
Particle size of abrasive paper: P240
Polishing time: 3 min 45
Pressure on samples: 449 g/cm$^2$
Speed of rotation of plate: 250 rpm
Samples treated: 3
Material polished: steel
Polished under water: yes
Removal of metal: 0.27 g The profile of the sample is rounded.

TEST NO. 10 (Comparative)

ALUMINIUM PLATE: Hardness 100 SHR D
Test conditions: 3 samples of FI steel 30 mm adhesively bonded under support - speed of rotation of plate 250 rpm - pressure 449 g/cm$^2$

| CYCLE | STARTING WEIGHT | LENGTH OF CYCLE | ABRASIVE | WEIGHT OBTAINED | M.R. (g) | REMARKS |
|---|---|---|---|---|---|---|
| 1 | 436.4 | 1'15" | P240 | 436.22 | 0.18 | From the third cycle |
| 2 | 436.22 | 1'15" | P240 | 435.98 | 0.24 | onwards the abrasive paper |
| 3 | 435.98 | 1'15" | P240 | 435.98 | 0 | appears to be worn out. |
| 4 | 435.98 | 1'15" | P240 | 435.93 | 0.05 | The measurements become |
| 5 | 435.93 | 1'15" | P240 | 435.91 | 0.02 | random. |
| 6 | 435.91 | 1'15" | P240 | 435.89 | 0.02 | TOTAL MR = 0.52 g |
| 7 | 435.89 | 1'15" | P240 | 435.86 | 0.01 | |
| CONFIRMATION OF TEST WITH NEW ABRASIVE PAPER | | | | | | |
| 1 | 433.18 | 1'15" | P240 | 432.93 | 0.25 | TOTAL MR = 0.54 g |
| 2 | 432.93 | 1'15" | P240 | 432.66 | 0.27 | |
| 3 | 432.66 | 1'15" | P240 | 432.64 | 0.02 | |
| 4 | | | | | | |
| 5 | | | | | | |

TEST NO. 11

ALUMINIUM PLATE WITH TEFLON COATING: Hardness 50/60 SHR D
Thickness 100 micron
Test conditions: 3 samples of FI steel 30 mm adhesively bonded under support - speed of rotation of plate 250 rpm - pressure 449 g/cm$^2$

| CYCLE | STARTING WEIGHT | LENGTH OF CYCLE | ABRASIVE | WEIGHT OBTAINED | M.R. (g) | REMARKS |
|---|---|---|---|---|---|---|
| 1 | 434.08 | 1'15" | P240 | 433.85 | 0.23 | TOTAL MR = 0.43 g |
| 2 | 433.85 | 1'15" | P240 | 433.81 | 0.04 | |
| 3 | 433.81 | 1'15" | P240 | 433.74 | 0.07 | |
| 4 | 433.74 | 1'15" | P240 | 433.71 | 0.03 | |
| 5 | 433.71 | 1'15" | P240 | 433.68 | 0.03 | |
| 6 | 433.68 | 1'15" | P240 | 433.66 | 0.02 | |
| 7 | 433.66 | 1'15" | P240 | 433.64 | 0.02 | |
| CONFIRMATION OF TEST WITH NEW ABRASIVE PAPER | | | | | | |
| 1 | 433.59 | 1'15" | P240 | 433.46 | 0.13 | TOTAL MR = 0.35 g |
| 2 | 433.46 | 1'15" | P240 | 433.34 | 0.12 | |
| 3 | 433.34 | 1'15" | P240 | 433.3 | 0.04 | |
| 4 | 433.3 | 1'15" | P240 | 433.27 | 0.03 | |
| 5 | 433.27 | 1'15" | P240 | 433.24 | 0.03 | |

TEST NO. 12

PVC PLATE (Standard): Hardness 83 SHR D
Thickness 12 mm
Test conditions: 3 samples of FI steel 30 mm adhesively bonded under support - speed of rotation of plate 250 rpm - pressure 449 g/cm$^2$

| CYCLE | STARTING WEIGHT | LENGTH OF CYCLE | ABRASIVE | WEIGHT OBTAINED | M.R. (g) | REMARKS |
|---|---|---|---|---|---|---|
| 1 | 435.53 | 1'15" | P240 | 435.37 | 0.16 | TOTAL MR = 0.37 g |
| 2 | 435.37 | 1'15" | P240 | 435.3 | 0.07 | |
| 3 | 435.3 | 1'15" | P240 | 435.28 | 0.02 | |
| 4 | 435.28 | 1'15" | P240 | 435.25 | 0.03 | |
| 5 | 435.25 | 1'15" | P240 | 435.23 | 0.02 | |
| 6 | 435.23 | 1'15" | P240 | 435.2 | 0.03 | |
| 7 | 435.2 | 1'15" | P240 | 435.16 | 0.04 | |
| CONFIRMATION OF TEST WITH NEW ABRASIVE PAPER | | | | | | |
| 1 | 434.71 | 1'15" | P240 | 434.61 | 0.1 | TOTAL MR = 0.21 g |
| 2 | 434.61 | 1'15" | P240 | 434.57 | 0.04 | |
| 3 | 434.57 | 1'15" | P240 | 434.54 | 0.03 | |

TEST NO. 12-continued

| | | | | | |
|---|---|---|---|---|---|
| 4 | 434.54 | 1'15" | P240 | 434.5 | 0.04 |
| 5 | 434.5 | 1'15" | P240 | 434.5 | 0 |

TEST NO. 13 (Comparative)

RUBBER COATED PLATE: Hardness 12 SHR D
Thickness 4 mm

Test conditions: 3 samples of FI steel 30 mm adhesively bonded under support - speed of rotation of plate 250 rpm - pressure 449 g/cm$^2$

| CYCLE | STARTING WEIGHT | LENGTH OF CYCLE | ABRASIVE | WEIGHT OBTAINED | M.R. (g) | REMARKS |
|---|---|---|---|---|---|---|
| 1 | 437.37 | 1'15" | P240 | 437.19 | 0.18 | From the third cycle |
| 2 | 437.19 | 1'15" | P240 | 437.15 | 0.04 | onwards the abrasive paper |
| 3 | 437.15 | 1'15" | P240 | 437.15 | 0 | appears to be worn out. |
| 4 | 437.15 | 1'15" | P240 | 437.09 | 0.06 | The measurements become |
| 5 | 437.09 | 1'15" | P240 | 437.08 | 0.01 | random. Substantial dips in |
| 6 | 437.08 | 1'15" | P240 | 437.05 | 0.03 | edge visible to naked eye |
| 7 | 437.05 | 1'15" | P240 | 437.05 | 0 | TOTAL MR = 0.32 g |

In these tests MR denotes material removed.

I claim:

1. A polishing disc support comprising a body in the form of a disc, the disc having two sides one of which has a centre, a blind centering hole being provided in said centre and a blind drive hole being provided in an eccentric position in this same side, wherein a coating of a material which is softer than that of the body is applied to the other side in a thickness of between 5 $\mu$m and 4 mm.

2. The support according to claim 1, wherein the coating has a Shore hardness D greater than 12.

3. The support according to claim 1, wherein the coating is polytetrafluoroethylene.

4. A polishing disc comprising a body in the form of a disc, the disc having two sides one of which has a center at which is located a blind centering hole, at least one additional blind hole being provided in said disc and configured to connect to a mechanism to rotate said disc; a coating of a material which is softer than that of the body being applied to one side of said disk in a thickness of between 5 $\mu$m and 4 mm so the coating moves simultaneously with the body, and a sheet of abrasive material fastened over the coating.

5. A polishing disc as defined in claim 4, wherein the coating has a shore hardness greater than 12.

6. A polishing disc as defined in claim 4, wherein the body is made of metal and the coating has a shore hardness greater than 12.

7. A polishing disc as defined in claim 4, wherein the body is made of metal and the coating comprises polytetrefluoroethylene.

8. A polishing disc as defined in claim 4, wherein the thickness is between about 5 $\mu$m and 2 mm.

9. A polishing disc as defined in claim 7, wherein the thickness is between about 5 $\mu$m and 2 mm.

* * * * *